United States Patent [19]

Fontenot

[11] Patent Number: 4,818,146

[45] Date of Patent: Apr. 4, 1989

[54] WELLHEAD AND CONDUCTOR STABILIZED BY A CABLE AND ANCHOR SYSTEM

[75] Inventor: Ozeman J. Fontenot, Youngsville, La.

[73] Assignee: Texhoma Contractors, Inc., Youngsville, La. ; a part interest

[21] Appl. No.: 694,014

[22] Filed: Jan. 23, 1985

[51] Int. Cl.[4] ..... E02B 3/22; E02D 7/00

[52] U.S. Cl. ..... 405/212; 405/224; 405/228

[58] Field of Search ..... 405/195, 212–215, 405/224, 227, 228, 244

[56] References Cited

U.S. PATENT DOCUMENTS

| | | | |
|---|---|---|---|
| 1,359,956 | 11/1920 | Boardman | 405/228 |
| 2,986,889 | 6/1961 | Ludwig | 405/224 |
| 3,118,417 | 1/1964 | Stanwick | 405/224 X |
| 4,005,672 | 2/1977 | Files | 405/215 X |

FOREIGN PATENT DOCUMENTS

| | | | |
|---|---|---|---|
| 12722 | 1/1982 | Japan | 405/228 |
| 2075096 | 11/1981 | United Kingdom | 405/224 |

*Primary Examiner*—David H. Corbin

*Attorney, Agent, or Firm*—Keaty & Keaty

[57] ABSTRACT

A wellhead and conductor pipe supported by a cable and anchor system is disclosed which is comprised of a plurality of anchor cables secured to the conductor at a first end of each cable, the second end of each cable being fixed to an anchor pile in a surrounding land formation beneath a body of water. In preferred embodiments the cables are secured to the conductor by means of an annular brace having an upper collar portion to which the first end of each cable is attached and a lower collar portion having pulleys mounted thereon and around which the cables are journalled. Anchor piles are driven into the subsea land formation by releasably securing an anchor pile to a drive pile and exerting a downward force on the drive pile to drive the anchor pile into anchoring engagement with the formation below the mud line. In especially preferred embodiments, the length of the drive pile is extended by providing coaxially alignable extension pipes with reduced diameter ends that fit into the open upper end of the existing drive pile. Adjacent sections of drive pipe extensions can be interconnected to one another using means such as cables which permit drive pile extensions to be disconnected from one another after the anchor piles have been driven into the land formation.

1 Claim, 4 Drawing Sheets

WELLHEAD AND CONDUCTOR STABILIZED BY A CABLE AND ANCHOR SYSTEM

BACKGROUND OF THE INVENTION

1. Field of the Invention

This invention concerns a stabilizer system for an offshore wellhead and conductor pipe. It also includes a method for driving anchor piles into a subsea land formation.

2. General Discussion of Background of the Invention

In drilling an offshore well, a standing conductor is provided through which subterranean fluids move to the surface of the water. The conductor supports a wellhead above the surface of the water, the wellhead helping control movement of fluid from the conductor. In some cases a platform is erected around the conductor and wellhead to support and protect it, but in other cases a protective caisson, having a typical diameter of 48 or 60 inches, is placed around the original conductor and driven to refusal into the mud at the bottom of the body of water. The latter method of protection employing the protective caisson results in what is known as a well protector, and it significantly increases the cost of installing the well. The well protector is, however, necessary in protecting the well against winds, stormy seas and other environmental factors that might impart destabilizing forces to the well.

SUMMARY OF THE INVENTION

The present invention provides a new stabilizer for an offshore well which is easy to install and less expensive than presently used alternatives such as protective caissons. A stabilizer is provided for an offshore wellhead and conductor, the conductor having a portion thereof driven into a formation beneath the mudline of a body of water. The stabilizer comprises an annular brace secured to the conductor, the brace including a plurality of pulleys symmetrically disposed around the brace below the surface of the body of water. A plurality of cables is each secured at a first end of the cable to the brace, and each of the cables is journaled around one pulley and extends outwardly and downwardly from the pulleys of the brace down to the mudline. The cable is secured at its second end to an anchor pile beneath the mudline for holding the cables in a fixed position. The tension in all of the cables is balanced so that they stabilize the caisson and wellhead. In especially preferred embodiments, a boat landing bumper is carried by the brace at the surface of the water.

A method for stabilizing the wellhead and conductor comprises providing a brace for placement around the conductor, the brace being provided with a plurality of outwardly extending stationary attachment means. Each attachment means is provided with a corresponding pulley mounted on the brace, and the pulleys are symmetrically disposed around the brace in a single plane. The second end of an anchor cable is attached to an anchor pile, and the anchor pile is releasably secured in coaxial alignment to a drive pile by means of a connecting cable fixed to the drive pile at a first end of the connecting cable and fixed at a second end of the connecting cable to a padeye clamp provided with a clamp release cable that extends to the surface of the water. The padeye clamp, which opens when a clamp release cable attached to it is pulled, is secured in clamping engagement with a projection on the anchor pile to hold the anchor pile and drive pile in selectively interconnected coaxially aligned relationship.

A downward force is exerted on the drive pile to drive the anchor pile into anchoring engagement with the formation beneath the mud line, and the clamp release cable is pulled to open the padeye clamp and release the anchor pile from the drive pile. Each of the anchor cables is then journalled around one of the pulleys between the pulley and the brace and the brace is moved downwardly on the conductor to dispose the pulleys beneath the surface of the water thereby preventing boats from becoming entangled in the cables that project outwardly and downwardly from the pulleys to the anchor piles. The anchor cables are then tightened by pulling them taut to remove slack from the cable and then fixing the first end of the cable to the attachment means on the collar.

In some embodiments of the invention, the water is too deep for a single drive pile to drive the anchor pile completely beneath the mud line. In these situations the drive pile is lengthened by releasably connecting an extension pipe section in end to end, coaxially aligned relationship to the drive pile by providing a reduced diameter portion on the end of the extension which fits into the inside of the end of the drive pile. The drive pile and extension pipe are held in interconnected relationship by a pair of cables so that the drive pile and extension pipe can be selectively assembled and disassembled.

DETAILED DESCRIPTION OF THE PREFERRED EMBODIMENT

Figure 1:
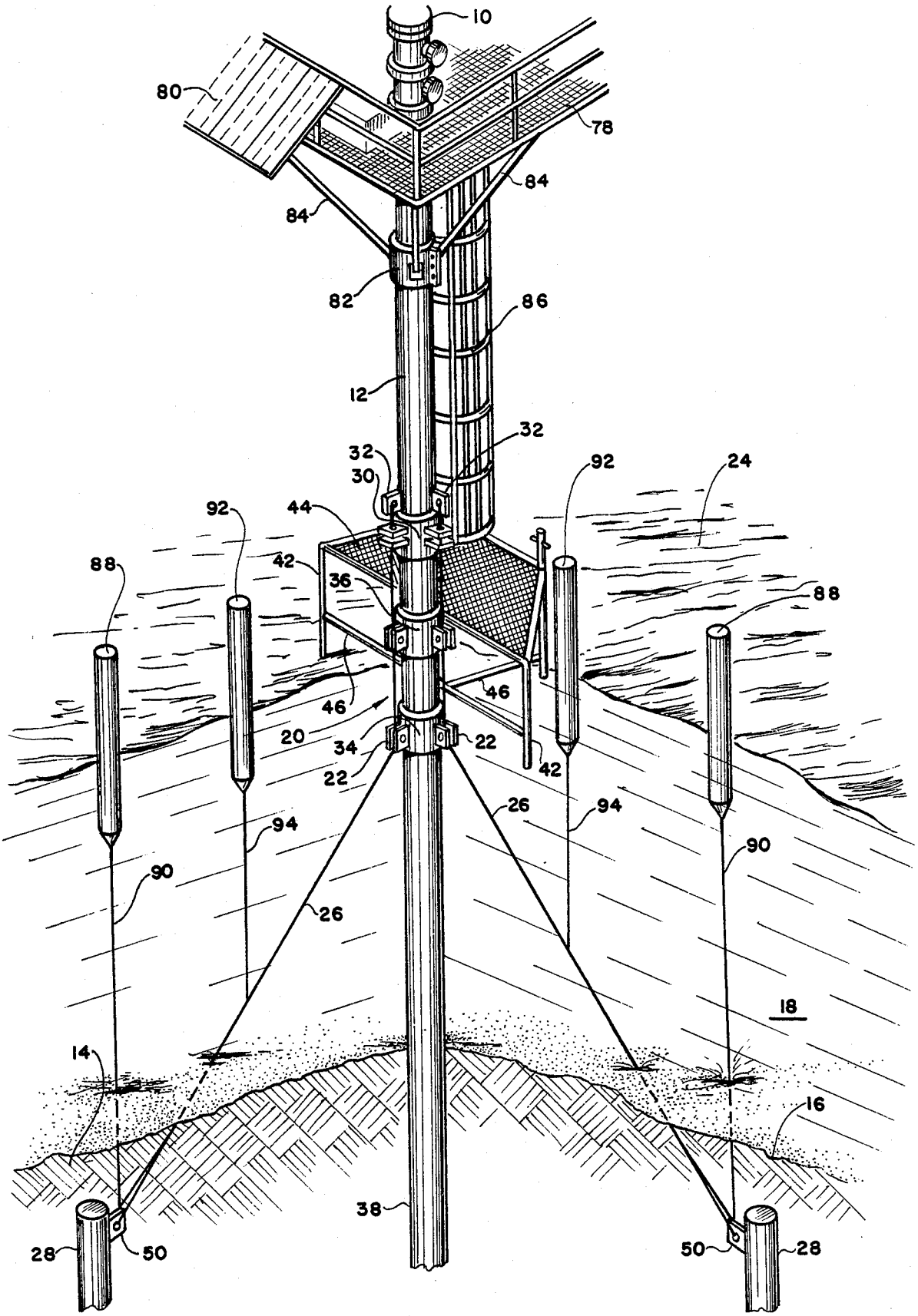
FIG. 1 is a perspective view of the offshore wellhead and conductor supported by three cables (only two of which are shown), the cables being attached to anchor piles driven beneath the mud line for stabilizing the conductor and wellhead.
Figure 3:
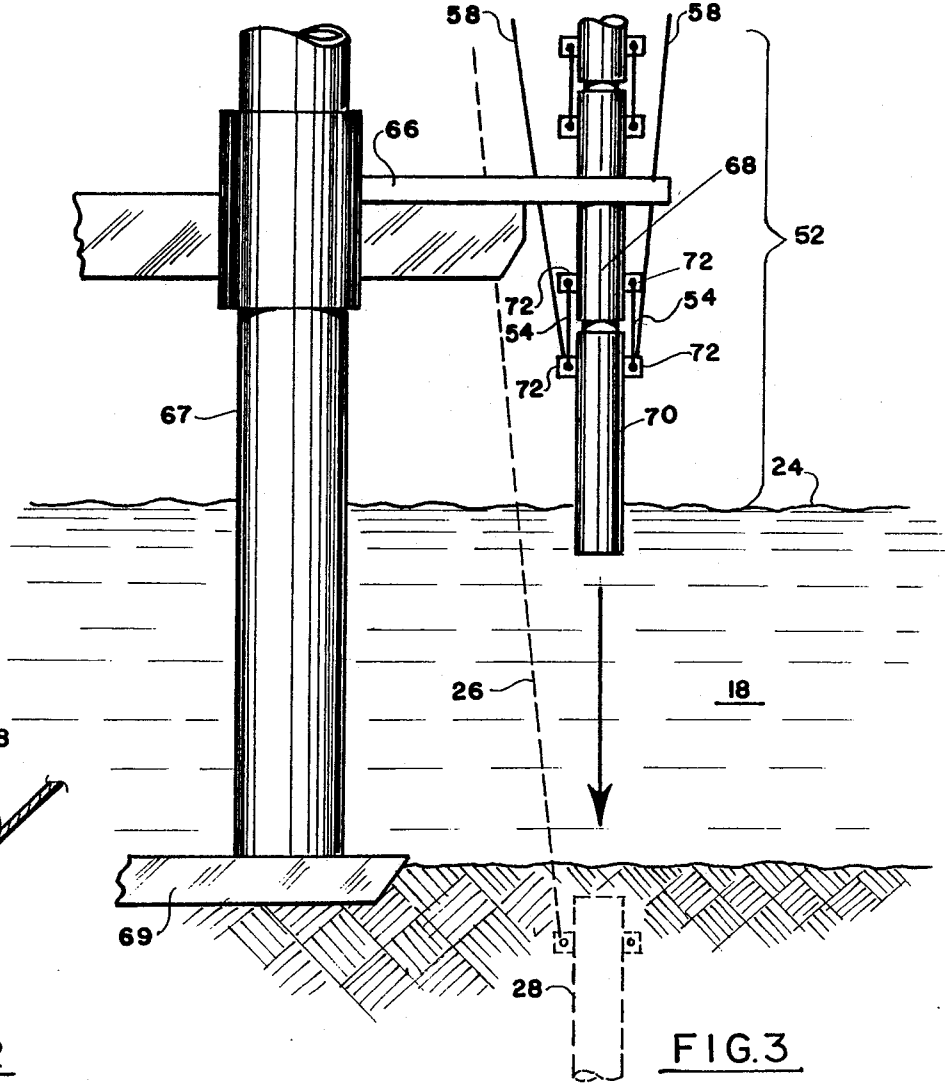
FIG. 3 is a side view, partially in cross section, illustrating the method of driving the anchor pile into the formation below the mud line by releasably connecting it to a plurality of sections which comprise a drive pile, the final position of the anchor pile beneath the mudline being shown in phantom.

A stabilizer for an offshore wellhead 10 supported by a conductor 12 is shown in FIG. 1. Conductor 12 is partially driven into a formation 14 beneath a mud line 16 of a body of water 18. The stabilizer comprises an annular brace 20 secured to conductor 12, the brace being provided with a plurality of pulleys 22 symetrically disposed around brace 20 below the surface 24 of body of water 18. In the embodiment shown in FIGS. 1 and 6, three pulleys 22 are disposed around brace 20, but only two of those pulleys are visible in the figures. The third pulley is hidden behind the conductor. In especially preferred embodiments the pulleys are positioned 15–17 feet below the surface of the water for reasons which will be described below.

A plurality of anchor cables 26 is provided, each anchor cable being secured at a first end to brace 20. Each cable is journalled around one pulley 22 and extends outwardly and downwardly from brace 20 to mudline 16. An anchor pile 28 is provided beneath mudline 16 to which a second end of each cable 26 is secured. Anchor piles 28 therefore provide a means for anchoring the second end of each cable to a fixed position such that the tension in the cables creates a net force of zero on the conductor to stabilize the conductor and wellhead.

If the cables were attached to the brace at or above the surface of the water, they would present a navigational hazard to boats near the conductor. Placement of the pulleys 15–17 feet below the surface of the water keeps the anchor cables near the conductor until the cables are a sufficient distance below the water surface to avoid entanglement with boats. Only then do the cables begin to radiate outwardly from the conductor toward the anchor piles.

Turning now in greater detail to brace 20, it is comprised of an upper collar portion 30 having an outwardly extending plurality of attachment means 32. Brace 20 is further provided with a lower collar portion 34 having pulleys 22 mounted thereon and projecting outwardly therefrom symetrically disposed around lower collar portion 34. In the embodiment shown in FIG. 1, brace 20 is also provided with an intermediate collar portion 36. In the embodiment shown in FIG. 6, two intermediate collar portions 36 are shown. These intermediate collar portions provide for additional stability of the collar and stabilizer, but the number of intermediate collar portions is a matter of design choice.

Figure 5:
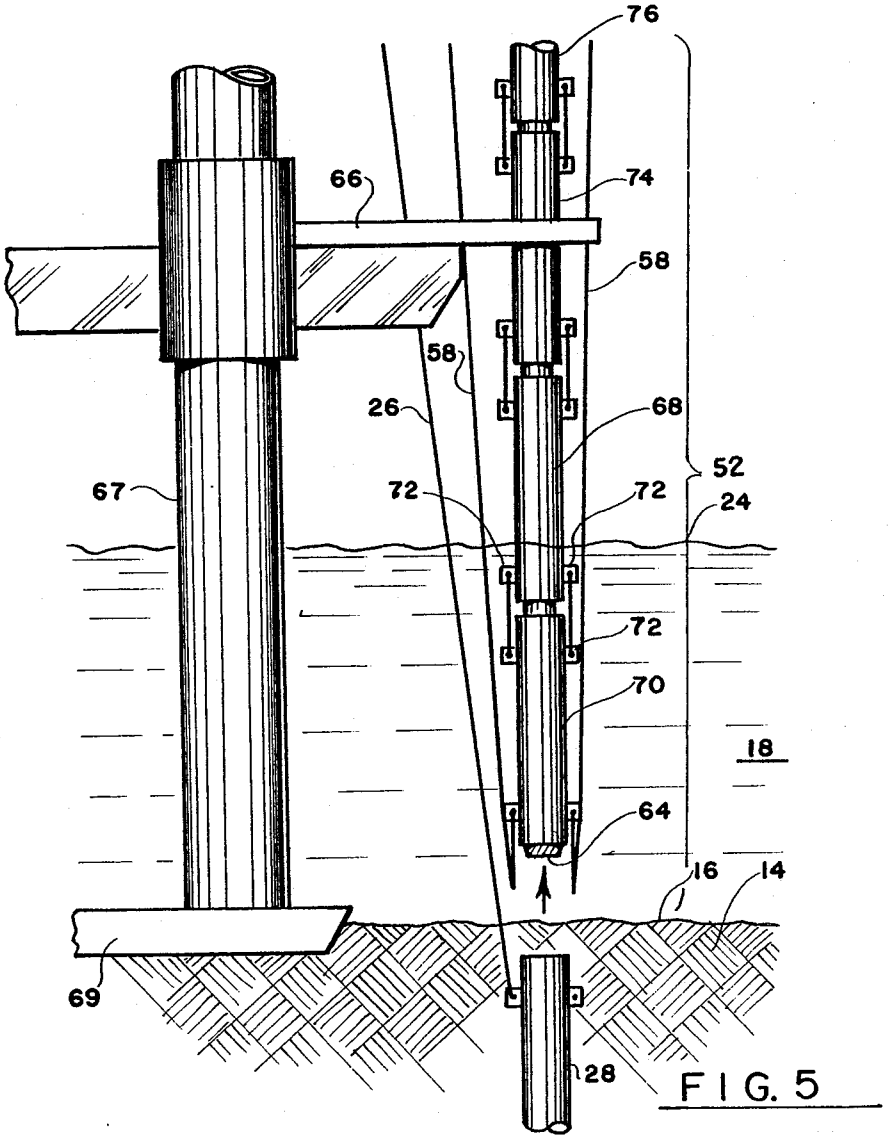
FIG. 5 is a view similar to FIG. 4 showing release of the anchor pile from the drive pile.
Figure 6:
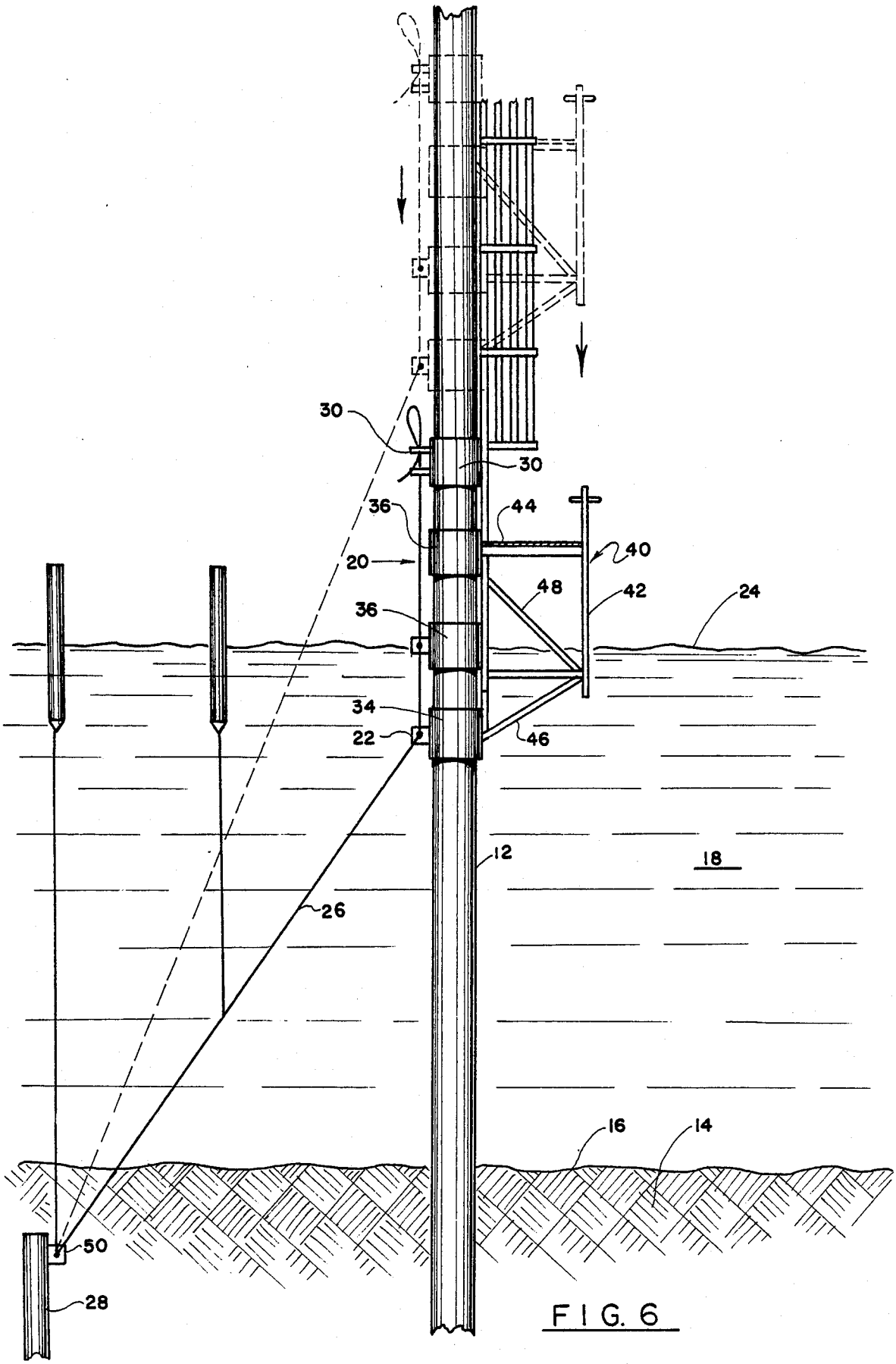
FIG. 6 is a side view, partially in cross-section, showing the method of installing the brace around the conductor.

The method for stabilizing an offshore wellhead 10 and conductor 12 having a portion 38 thereof driven beneath the mudline 16 of a body of water 18 is best shown in FIGS. 2–6. As shown in FIG. 6, the brace 20 is either constructed around conductor 12 above surface 24 or is prefabricated and placed around the conductor above the surface of the water. The brace is provided with a plurality of outwardly extending stationary attachment means 32, in the form of a flange like member projecting outwardly from upper collar portion 30. Each attachment means 32 has corresponding pulley 22 mounted on lower collar portion 34 and extending outwardly therefrom, pulleys 22 being symmetrically disposed around the brace in a single plane. In those preferred embodiments of the invention in which three cables are used to stabilize conductor 12, pulleys 22 are disposed at approximately a 120° angle from each adjacent pulley. Similarly, attachment means 32 are disposed symmetrically around upper collar portion 30 at about a 120° separation from one another. Attachment means 32 are also preferably aligned such that each attachment means is directly above its corresponding pulley.

A boat landing 40 is provided on brace 20, landing 40 providing a dock like structure against which boats may land so that personnel can disembark from the boat to service the well. Landing 40 is comprised of a plurality of vertical members 42 which form depending legs from platform 44. Platform 44 is welded to an intermediate collar portion 36, and diagonal members 46 depend downwardly and inwardly toward lower collar portion 34 to interconnect vertical member 42 with lower collar portion 34. An upwardly extending diagonal member 48 provides additional interconnection between vertical member 42 and intermediate collar portion 36.

Figure 2:
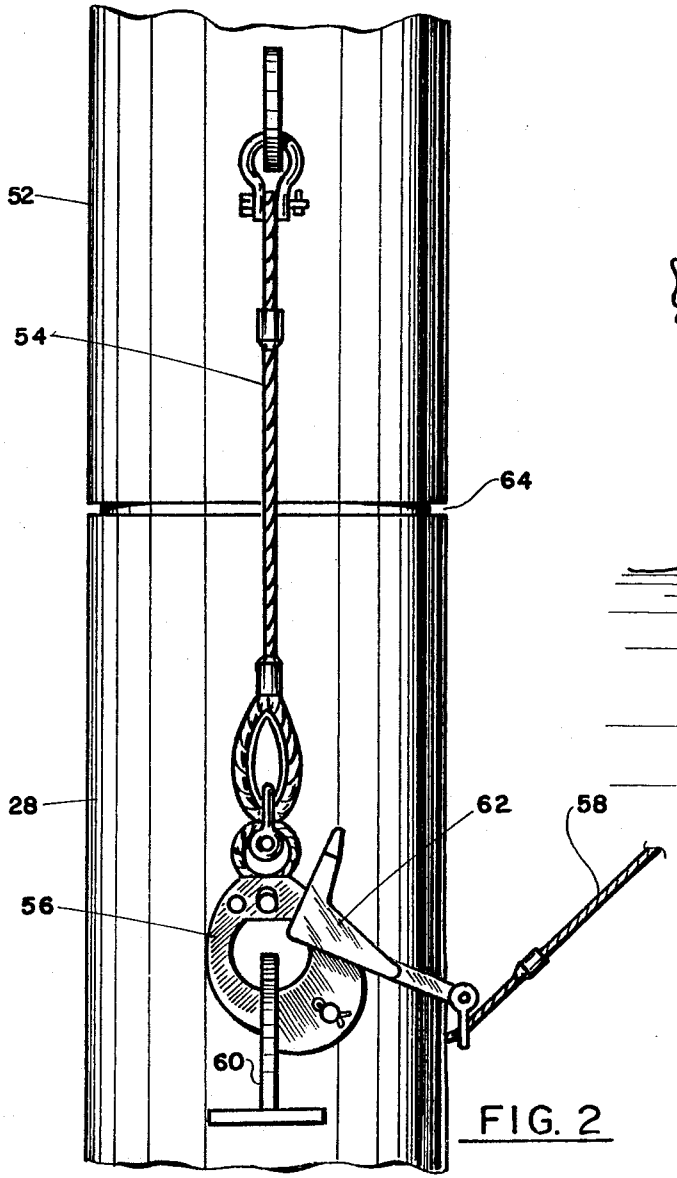
FIG. 2 is a side view of the means for interconnecting a drive pile to an anchor pile with a padeye clamp.

A second end of each anchor cable 26 is then attached to anchor pile 28 by means of an anchor flange 50 which forms an integral part of each anchor pile 28. A drive pile 52 is releasably secured to anchor pile 28 in coaxial alignment therewith. Drive pile 52 is releasably secured by means of a pair of connecting cables 54 fixed to an outwardly extending flange with a hole in it, the flange being integral with drive pile 52. Each connecting cable is fixed to drive pile 52 at a first end of each connecting cable 54 and fixed at a second end of the connecting cable to a padeye clamp 56 which is provided with a clamp release cable 58 that extends at least to surface 24 of water 18. As can be seen in FIG. 2, clamp 56 is, when closed, in clamping engagement with a radially outwardly extending flange 60 on the exterior of anchor pile 28. Cable 58 is attached to release member 62 that opens clamp 56 when an upward pulling force is exerted on clamp release cable 58 from the surface 24 of water 18.

The bottom end of drive pile 52 which is adjacent the upper end of anchor pile 28 into which drive pile 52 is inserted, is provided with a reduced diameter portion 64 (FIG. 2) that fits into anchor pile 28. This arrangement helps maintain anchor pile 28 and drive pile 52 in coaxial, interconnected relationship with the assistance of connecting cables 54.

A support skid 66 supported by vertical member 67 and horizontal support foot 69 is positioned around the drive pile above the surface of the water, and a downward force is exerted on drive pile 52 by repeatedly dropping a heavy weight on drive pile 52 in the manner known in the art. This downward force exerted on drive pile 52 drives anchor pile 28 into anchoring engagement with the land formation 14 beneath mudline 16 to the position shown in phantom in FIG. 3.

To keep the mudline free of debris, it is usually desirable to drive anchor pile 28 completely beneath mud line 16. In order to drive anchor pile 28 this deeply, drive pile 52 must be slightly longer than the depth of body of water 18. Since a drive pile that long would frequently be very clumsy to transport, the present invention provides a means for extending the length of the drive pile by releasably connecting a first extension pipe section 68 in end-to-end coaxially aligned relationship to the first section 70 of drive pile 52. The end of extension pipe 68 adjacent section 70 is provided with a reduced diameter portion 64 (which is the same structure as reduced diameter portion 64 provided on section 70) that fits into the inside of the end of section 70. Section 68 is provided with a pair of flanges which extend radially outwardly in opposite directions from section 68, and section 70 is provided with a complementary pair of radially outwardly extending flanges. Sections 68, 70 are held in end-to-end relationship by connecting cables 54 each of which is attached to one of the pair of flanges 72 on section 68 by placement through a hole in flange 72, while the other end of each connecting cable 54 is placed through a hole in its complementary flange on section 70. Connecting cable 54 can either be undone or severed to selectively release sections 68 and 70 from one another for disassembly of drive pile 52.

Figure 4:
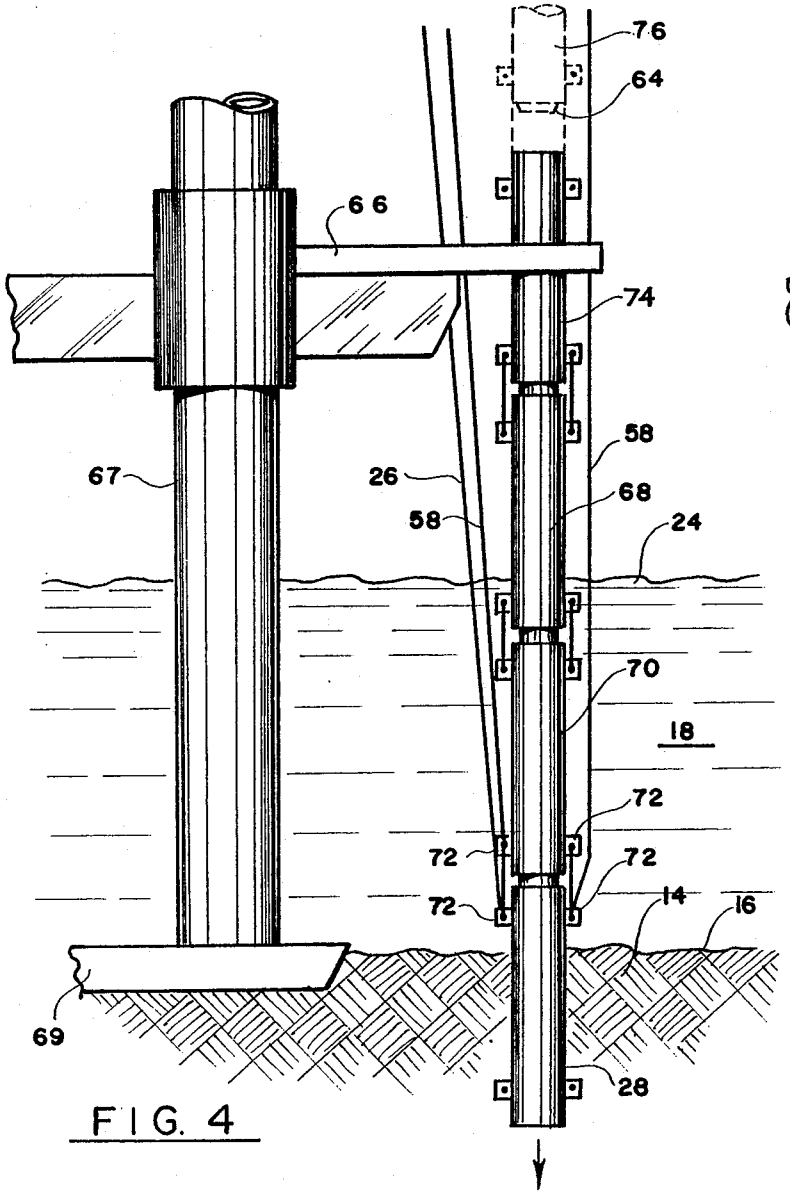
FIG. 4 is a view similar to FIG. 3 wherein the drive pile is comprised of multiple segments for extending the length of the drive pile.

Drive pile 52 can be extended as much as required by adding additional extension pipes, such as sections 74 and 76 which are shown in FIGS. 4 and 5. Each of sections 74, 76 is provided with an annular, reduced diameter lower portion 64 (See, e.g. FIG. 4) adapted for insertion into the upper end of the adjacent section to maintain the sections in co-axial alignment.

Once downward force has been exerted on drive pile 52 and anchor pile 28 has been driven to its desired position completely below mud line 16, an upward pulling force is exerted on clamp release cables 58 to open padeye clamp 56 and release drive pile 52 from anchor pile 28. In the meantime, the free end of anchor cable 26 has been held above the surface of the water and is threaded between one of the pulleys 22 and lower collar portion 34 of brace 20 which is placed around caisson 12. Brace 20 is in the position shown in phantom in FIG. 6 when anchor cable 26 is threaded around the pulley. Anchor cable 26 from each of anchor piles 28 is journalled around a corresponding, different pulley on brace 20. Brace 20 is then slid downwardly on the caisson to dispose the pulleys 22 approximately seventeen feet beneath surface 24 of water 18. Slack is then taken out of each anchor cable 26 to tighten each anchor cable, and then the cable is secured to attachment means 32 by knotting, clamping or the like. Each of the collar portions of brace 20 is welded to conductor 12 to secure them in place on caisson 12.

The conductor is now stabilized by the three anchor cables 26. The anchor piles have been placed so that the net force acting on the conductor is zero. The anchor cables project outwardly from conductor 12 a sufficient distance below surface 24 of water 18 to avoid entanglement with boats.

As seen in FIG. 1, wellhead 10 is surrounded by a platform 7 on which workmen may stand when servicing wellhead 10. Platform 78 is provided with solar panel 80 which provides electrical energy for operating a foghorn, beacon or other electrical devices. Platform 78 is held in place by a support brace 82 welded to caisson 12 and having diaganolly extending support arms 84 welded to platform 78 for maintaining platform 78 in a horizontal disposition. Ladder 86 is provided between platform 44 and platform 78 so that workmen can reach platform 78 from boat landing 40 by climbing up ladder 86.

The position of anchor pile 28 can be marked with a buoy 88 which is attached by buoy line 90 to anchor flange 50 of anchor pile 28 before the anchor pile is driven beneath the mudline 16. Similarly, the location of anchor cable 26 can be marked by buoy 92 which is tied to anchor cable 26 by line 94.

Changes and modifications in this specifically described embodiment can be carried out without departing from the scope of the invention which is set forth in the appended claims.

I claim:

1. A method for stabilizing an offshore wellhead and conductor having a portion thereof driven into a formation beneath a mud line of a body of water, the method comprising the steps of:

providing a brace for placement in fixed engagement around the conductor, the brace being provided with a plurality of outwardly extending stationary attachment means, each attachment means having a corresponding pulley mounted on the brace, the pulleys being symmetrically disposed around the brace in a single plane;

providing a boat landing bumper on the brace;

attaching a first end of an anchor cable to an anchor pile;

releaseably securing the anchor pile to a drive pile with a connection means comprised of a pair of connecting cables fixed to the drive pile at a first end of each of the connecting cables and fixed at a second end of each of the connecting cables to the anchor pile with a padeye clamp provided with a clamp release cable that extends to the surface of the water, the clamp release cables opening the padeye clamps when pulled;

exerting a downward force on the drive pile to drive the anchor pile into anchoring engagement with the land formation beneath the mud line;

pulling the clamp release cables to open the padeye clamps and releasing the anchor pile from the drive pile;

threading each anchor cable between one of the pulleys and the conductor;

sliding the brace downwardly on the conductor to dispose the pulleys beneath the surface of the water; and tightening each anchor cable and fixing it to the attachment means.

* * * * *